US008176633B2

(12) United States Patent
Knauf

(10) Patent No.: US 8,176,633 B2
(45) Date of Patent: May 15, 2012

(54) METHOD FOR THE PRODUCTION OF A FASTENING ELEMENT FOR DRY CONSTRUCTION ELEMENTS

(75) Inventor: Alfons Jean Knauf, Wiesbaden (DE)

(73) Assignee: Richter System GmbH & Co. KG, Griesheim (DE)

( * ) Notice: Subject to any disclaimer, the term of this patent is extended or adjusted under 35 U.S.C. 154(b) by 0 days.

(21) Appl. No.: 13/212,704

(22) Filed: Aug. 18, 2011

(65) Prior Publication Data

US 2011/0296897 A1 Dec. 8, 2011

Related U.S. Application Data

(60) Division of application No. 12/291,152, filed on Nov. 6, 2008, now Pat. No. 8,028,495, which is a continuation of application No. PCT/EP2007/003902, filed on May 3, 2007.

(30) Foreign Application Priority Data

May 8, 2006 (DE) ..... 10 2006 021 556

(51) Int. Cl.
*B23P 17/00* (2006.01)

(52) U.S. Cl. ..... 29/895.31; 52/850

(58) Field of Classification Search ..... 52/364, 52/712, 849, 850; 29/895, 895.3, 895.31
See application file for complete search history.

(56) References Cited

U.S. PATENT DOCUMENTS

| | | | |
|---|---|---|---|
| 2,664,179 | A | 12/1953 | Gwynne |
| 2,706,315 | A | 4/1955 | Price |
| 3,129,792 | A | 4/1964 | Gwynne |
| 3,243,930 | A | 4/1966 | Slowinski |
| 3,273,976 | A | 9/1966 | Wogerbauer |
| 5,689,990 | A | 11/1997 | Deeley |
| 2003/0154686 | A1 | 8/2003 | Platt |
| 2009/0223167 | A1 | 9/2009 | Anderson |
| 2009/0249743 | A1 | 10/2009 | Bodnar |

FOREIGN PATENT DOCUMENTS

| | | |
|---|---|---|
| CH | 486 281 | 4/1970 |
| EP | 0 279 798 | 8/1988 |
| GB | 2 095 595 | 10/1982 |
| WO | WO 82/03347 | 10/1982 |
| WO | WO 94/12294 | 6/1994 |
| WO | WO 97/23694 | 7/1997 |
| WO | WO 97/35674 | 10/1997 |

OTHER PUBLICATIONS

Dietrich Industries Medium Duty Metal Stub (May 2003 archived webpage).

*Primary Examiner* — Jeanette E Chapman
*Assistant Examiner* — Daniel Kenny
(74) *Attorney, Agent, or Firm* — Pearl Cohen Zedek Latzer, LLP

(57) ABSTRACT

A method for the production of a fastening element for dry construction elements involving feeding a flat sheet metal material through a nip formed between a top roller having first teeth and a bottom roller having second teeth, in order to create depressions and elevations as well as slanted sliding surfaces.

7 Claims, 6 Drawing Sheets

METHOD FOR THE PRODUCTION OF A FASTENING ELEMENT FOR DRY CONSTRUCTION ELEMENTS

CROSS REFERENCE TO RELATED APPLICATIONS

This is a divisional application of U.S. patent application Ser. No. 12/291,152, filed on Nov. 6, 2008, which claims priority to German patent application No. DE 10 2006 021 556.7 filed on May 8, 2006, through PCT/EP2007/003902 filed on May 3, 2007, hereby incorporated by reference herein.

BACKGROUND OF THE INVENTION

The present invention relates to a fastening element for dry construction elements and to a method for the production of such a fastening element.

Swiss patent specification CH 486 281 describes a corrugated panel made of metal with two corrugations that intersect each other. The corrugations form a depression on one side of the corrugated panel, and an elevation on the other side. In order to produce the corrugated panel, a strip of metal is fed between two toothed rollers.

Another sheet metal material having projections and recesses is known from European patent application EP 0 674 551 B1, which describes a method for the production of such a material. According to this publication, the rollers used for the production have teeth in involute form.

In the method known from European patent application EP 0 891 234 B 1, the rollers used for the deformation of a sheet metal material are rollers that have rounded teeth on the top.

PCT/GB81/00095 discloses a metal sheet with a plurality of projections as well as a method for its production.

Fastening elements for dry construction elements are normally affixed with screws that are screwed into or through the sheet metal material. If the fastening element is configured to be flat at the screwing site, it is not always easy to precisely position the screws, since the screws can slip away when they are being screwed in, which is normally done with a battery-operated screwdriver. The provision of a corrugated area alone as is known from the state of the art, however, would not lead to optimal handling of the fastening element.

SUMMARY OF THE INVENTION

Therefore, an objective of the present invention provides a fastening element for dry construction elements that can be mounted especially easily, as well as a method for the production of such a fastening element.

The present invention provides a fastening element for dry construction elements that has a sheet metal material having at least one joining section, whereby the sheet metal material is provided with a plurality of depressions in the area of the at least one joining section, whereby the depressions are formed by deformed areas of the sheet metal material, so that the depressions on one side of the sheet metal material form elevations on the opposite side of the sheet metal material, whereby the depressions are each surrounded by sliding surfaces that are at least partially slanted relative to an imaginary center line of the sheet metal material and that are meant for connecting means that are to be inserted into or through the joining section.

The sliding surfaces allow an especially simple affixation of the fastening element. If screws are used for this purpose then, thanks to the effect of the sliding surfaces, they can slide into the next depression and be screwed in there. In this manner, the screws can always be inserted at precisely defined positions without this calling for any extra effort.

Screws can be inserted especially easily if the sliding surfaces each have an inclination angle of more than 5°, especially more than 7°, relative to the imaginary center line of the sheet metal material.

According to an especially advantageous embodiment of the invention, it is provided that, in the at least one joining section, the sheet metal material has no surface that is parallel to the imaginary center line of the sheet metal material, except for the depressions and/or elevations.

According to the invention, it has proven to be especially advantageous for the center point distance between the individual depressions to range between three times and ten times the thickness of the sheet metal material, especially between four times and six times the thickness of the sheet metal material. The term 'thickness' here refers to the thickness of the sheet metal material itself, that is to say, without taking depressions and elevations into account. In this context, it is achieved at the same time that the fastening element is easy to mount and has high stability values.

Moreover, it has proven its worth for the elevations and the depressions to be provided on both sides of the sheet metal material.

High stability, along with easy mounting, are also promoted by the fact that the elevations have a height that is between 0.8 times and 1.4 times the thickness of the sheet metal material, measured from the imaginary center line of the sheet metal material, and/or in by the fact that the depressions have a depth between 0.3 times and 2.0 times, especially between 0.3 times and 1.0 time the thickness of the sheet metal material, measured from the outer enveloping surface of the sheet metal material. The outer enveloping surface is formed by the highest points of the elevations.

According to an advantageous embodiment of the invention, it is provided that the thickness of the sheet metal material is between 0.2 mm and 2.0 mm, especially between 0.3 mm and 0.8 mm, preferably between 0.4 mm and 0.7 mm.

According to the invention, it can also be provided that the total height of the deformed sheet metal material in the joining section amounts to between two times and three times the thickness of the sheet metal material. The total height here—in contrast to the material thickness—is measured, taking into account the elevations that might be present on both sides.

According to the invention, the fastening element can be configured especially as a C-section, U-section, L-section, top hat section, T-section or Z-section.

An objective upon which the invention is based provides means of a method for the production of a fastening element according to the invention, in which an essentially flat sheet metal material is fed through a nip formed between a top roller having first teeth and a bottom roller having second teeth, in order to create the depressions and elevations as well as the slanted sliding surfaces.

Since the top roller and/or the bottom roller has a plurality of toothed disks arranged next to each other, depressions and elevations can be created in several rows next to each other. Such top rollers and bottom rollers are also very easy and cheap to produce since the individual toothed disks can be processed separately and are only joined at the end to form the top rollers and bottom rollers.

It is advantageously provided that the toothed disks have a row of first or second teeth on their circumference.

According to the invention, it has proven worthwhile for the teeth to each have four straight flanks that are preferably slanted by 25° to 35°, preferably by 30°, relative to the center plane of the disk.

Furthermore, it can be provided according to the invention that the first teeth of the top roller and the second teeth of the bottom roller intermesh and/or the top roller and the bottom roller are arranged in such a way that one of the first teeth protrudes into the middle of a gap between two of the second teeth.

Additional objectives, features, advantages and application possibilities of the present invention ensue from the description below of embodiments making reference to the drawings. In this context, all of the features described and/or illustrated, either on their own or in any desired combination, are the subject matter of the invention, also irrespective of their formulation in individual claims or of their referring back to other claims.

BRIEF DESCRIPTION OF THE DRAWINGS

The following is shown.

DETAILED DESCRIPTION

Figure 1A:
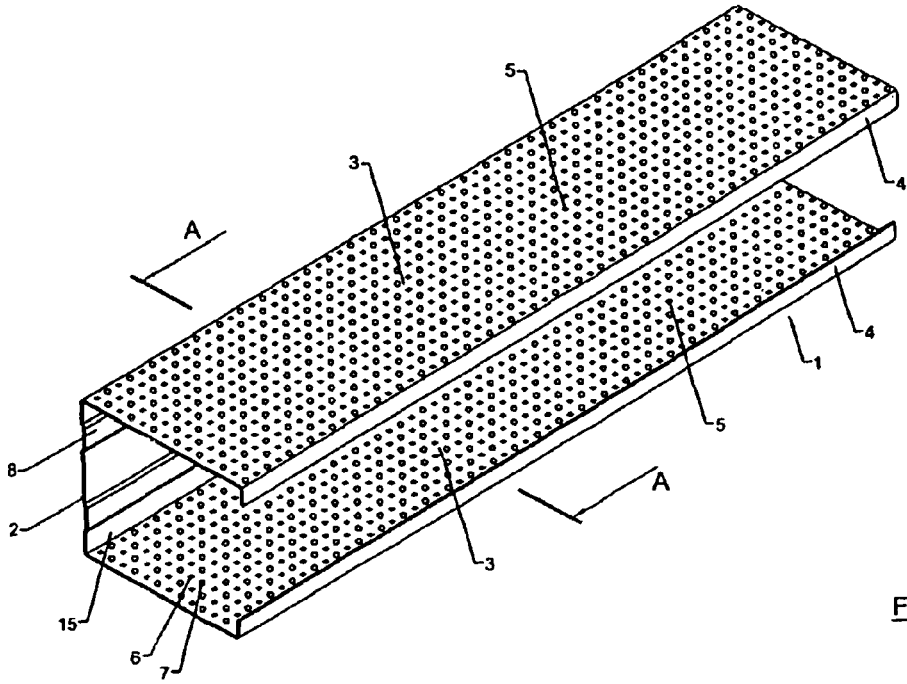
FIG. 1*a*: a perspective view of a fastening element according to the invention, in a first embodiment.
Figure 2:
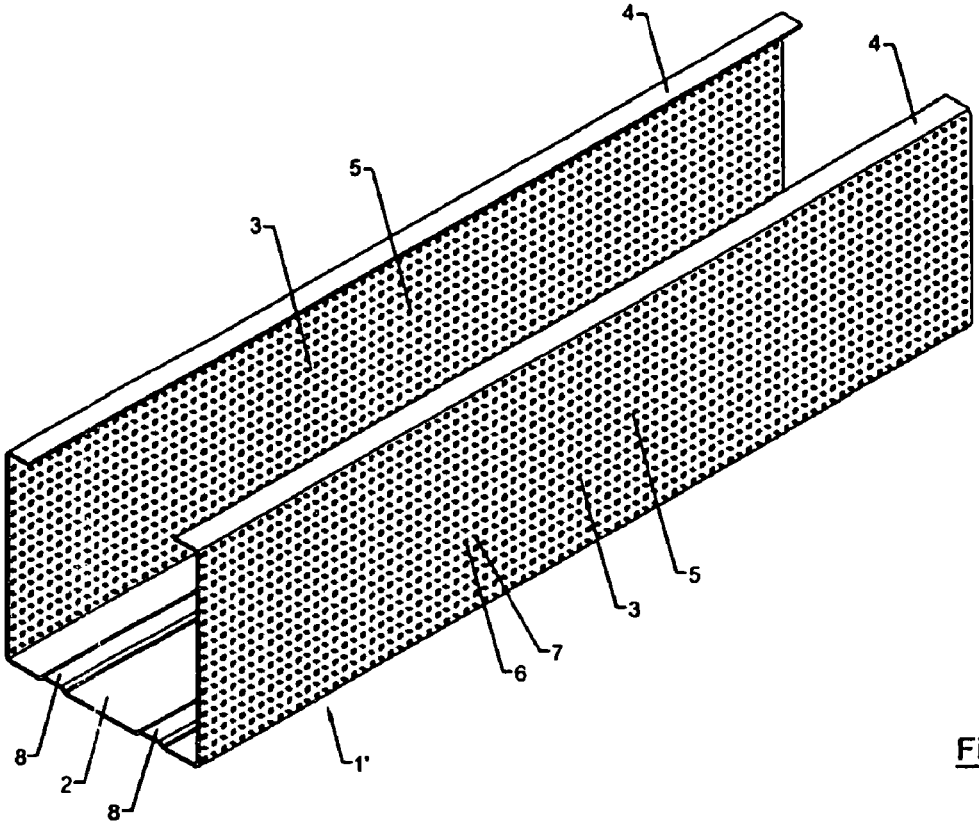
FIG. 2: a fastening element according to the invention, in another embodiment.
Figure 3:
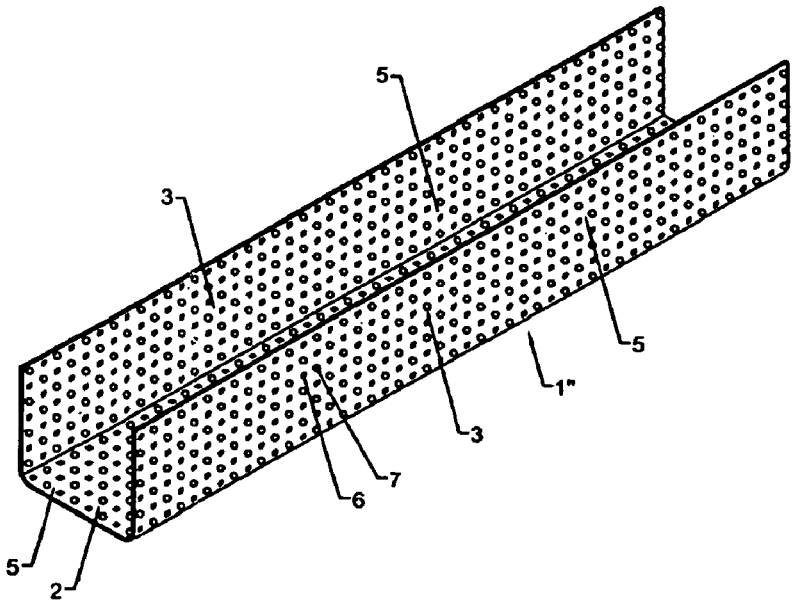
FIG. 3: a fastening element according to the invention, in another embodiment.

FIGS. 1*a*, 2 and 3 each show a fastening element 1, 1', 1" for dry construction elements. The fastening elements 1, 1', 1" are each made of a profiled sheet metal material having a bottom section 2 at whose ends bent leg sections 3 are provided. The leg sections 3, each of which forms a fastening flange, extend essentially perpendicular to the bottom section 2.

In the embodiments shown in FIGS. 1*a* and 2, each of the outer ends of the leg sections 3 has bent strips 4 that face inwards and that form support edges. Such fastening elements 1, 1' are also referred to as C-sections.

The fastening element 1" shown in FIG. 3, which does not have a bent strip at the outer ends of the leg sections 3, is a so-called U-section.

The described fastening elements 1, 1', 1" can be employed in dry construction as support structures, for example, for building partitions, suspended ceilings, etc.

The fastening elements 1, 1', 1" shown are made of metal, especially of galvanized sheet steel and, by means of a shaping procedure, are converted from an essentially flat sheet metal material into the three-dimensional shapes of the fastening elements 1, 1', 1" shown.

The sheet metal material of the fastening elements 1, 1', 1" has at least one joining section 5. In the embodiments shown in FIGS. 1 and 2, the two leg sections 3 are configured as a joining sector 5 and are provided in this area with a plurality of depressions 6 that are created by deformed areas of the sheet metal material. Diverging from the depiction, it is also possible to provide the joining sections with the depressions 6 on only part of the surface of the leg sections 3. In the fastening element 1" shown in FIG. 3, not only the leg sections 3 but also the bottom section 2 have such depressions 6.

The fact that, in the fastening elements 1, 1' shown in FIGS. 1*a* and 2, the bottom section 2 does not have any punctiform depressions but rather only beads 8 does not mean that the bottom section 2 would be utterly unsuitable to be joined to other components. In these two embodiments, however, the depressions 6 that make it easier to screw in joining elements such as, for example, screws, are restricted to the area where other components are frequently affixed.

Figure 1B:
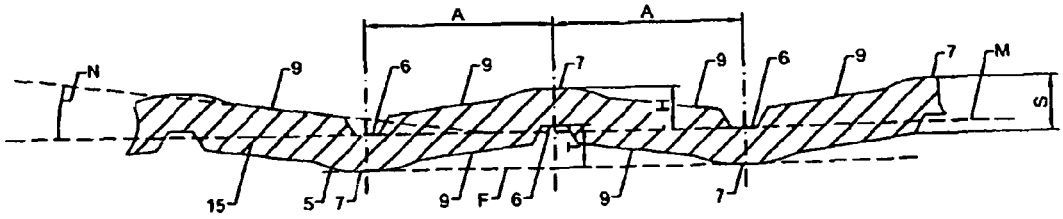
FIG. 1*b*: an enlarged view of a cross section through part of the joining section of the fastening element of FIG. 1*a;*

FIG. 1*b* shows an enlarged partial section through the sheet metal material of the fastening element 1 shown in FIG. 1*a* in the area of a joining section 5. Hence, there are no differences from the fastening elements 1', 1" shown in FIGS. 2 and 3. FIG. 1*b* clearly shows that the depressions 6 are formed by deformed areas of the sheet metal material, whereby the depressions 6 on one side of the sheet metal material form elevations 7 on the opposite side of the sheet metal material.

Here, the depressions 6 are each surrounded, at least partially, by sliding surfaces 9 that are slanted relative to an imaginary center line M of the sheet metal material and that are meant for connecting means that are to be inserted into or through the joining section 5. The sliding surfaces 9 here have an inclination angle N of more than 5°, especially more than 7°, with respect to the imaginary center line M of the sheet metal material. Accordingly, areas leading to the appertaining depression 6 are formed around the depression 6. As a consequence, screws can slide on the sliding surfaces 9 towards the depressions 6, as will be described in detail below.

It is also clear from FIG. 1*b* that the elevations 7 and the depressions 6 are present on both sides of the sheet metal material. In this context, in FIGS. 1*a* and 3, the elevations 7 are indicated by small circles and the depressions 6 by small diamonds.

According to the invention, the center point distance A between the individual depressions 6 preferably amounts to between three times and ten times the thickness S of the sheet metal material, especially between four times and six times the thickness S of the material. If, as shown, the depressions 6 are present on both sides of the joining section 5, the center point distance A between two adjacent depressions 6 is taken, irrespective of the side of the sheet metal material where the depression 6 in question is formed.

The elevations 7 preferably have a height H between 0.8 times and 1.4 times the thickness of the sheet metal material, measured from the imaginary center line M of the sheet metal material.

The depressions 6 have a depth T between 0.3 times and 2.0 times, especially between 0.3 times and 1.0 time the thickness S of the sheet metal material, measured from the outer enveloping surface F of the sheet metal material. The outer enveloping surface F is formed by the highest point of the individual elevations 7.

The thickness S of the sheet metal material preferably amounts to between 0.2 mm and 1.0 mm, especially between 0.3 mm and 0.8 mm, preferably between 0.4 mm and 0.7 mm.

Here, the depressions 6 and elevations 7 have the effect of increasing stability. This means that, at the same material thickness, the fastening element is considerably stronger than conventional fastening elements. This makes it possible to reduce the thickness S of the sheet metal material and thus also the production costs and yet to achieve a high strength.

The depressions 6 and elevations 7 are configured in such a way that the total height of the deformed sheet metal material in the joining section 5 amounts to between two times and three times the thickness S of the sheet metal material.

Figure 4A:
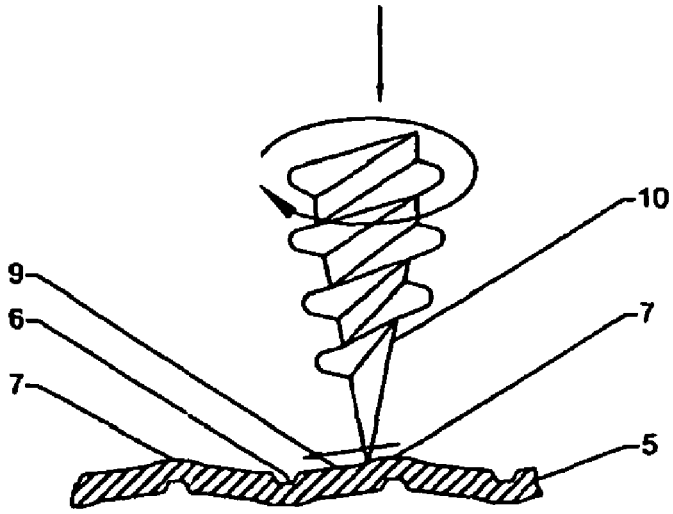
FIGS. 4*a*-4*c*: screwing in of a screw into a joining section of a fastening element according to the invention.
Figure 4B:
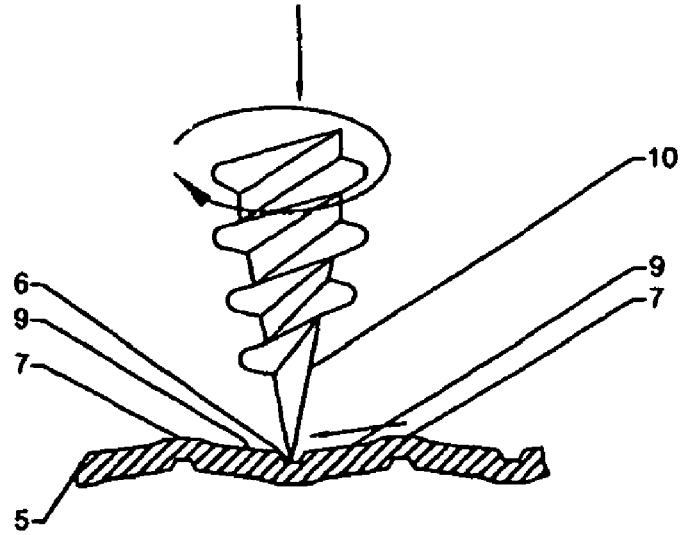
Figure 4C:
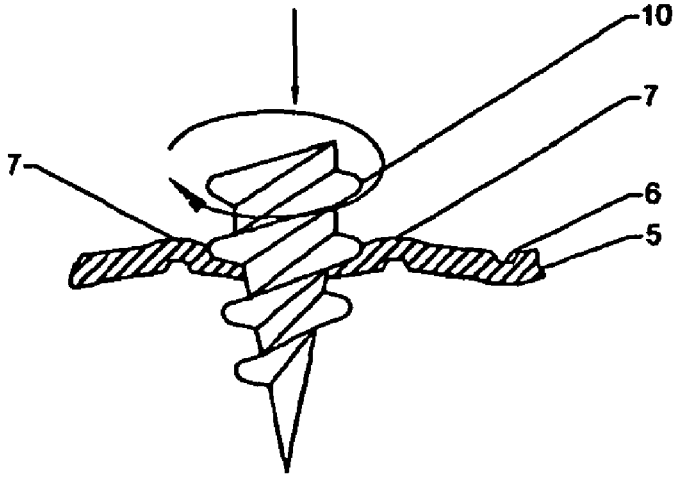

FIGS. 4*a*, 4*b* and 4*c* illustrate the advantageous effect of the sliding surfaces 9. If, as shown in FIG. 4*a*, a screw 10, of which only the tip is depicted, is placed on the joining section, the effect of the slanted sliding surfaces 9 causes the screw to easily slide to the next depression 6, settling there in a well-defined position. This is depicted in FIG. 4*b*. Now the screw 10 can be screwed with its tip into the continuous sheet metal material (FIG. 4*c*). The depression 6 prevents the screw 10 from slipping away while it is being screwed in. In this manner, screws 10 can be screwed into the joining section 5 very quickly and yet precisely.

Figure 5B:
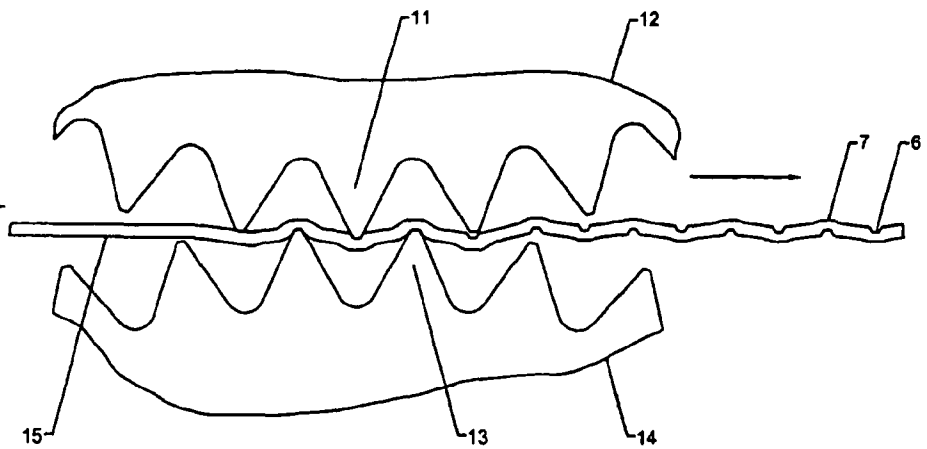
FIG. 5*b*: an enlarged section of FIG. 5*a;*
Figure 5A:
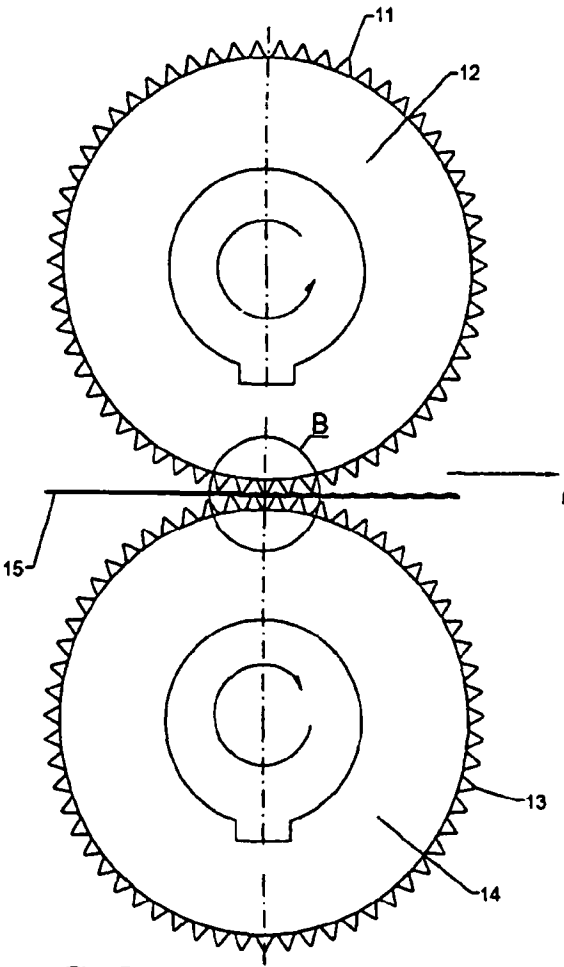
FIG. 5*a*: a schematic view of a top roller and a bottom roller according to the invention.

For the production of the fastening elements 1, 1', 1", an essentially flat sheet metal material 15 is fed through a nip formed between a top roller 12 having first teeth 11 and a bottom roller 14 having second teeth 13. This can be clearly seen in FIG. 5*a* and in the enlarged section depicted in FIG. 5*b*. It can be clearly seen how the flat sheet metal material 15 that is fed in from the left-hand side is deformed under the effect of the protruding and intermeshing first and second teeth 11, 13, thereby giving rise to the depressions 6 and elevations 7. Each tooth tip leaves a clear impression on the sheet metal material 15, so that the depressions 6 are formed in the surface of the sheet steel plate.

The sheet metal material 15 processed in this way can then be shaped in subsequent steps (not shown here) so as to yield, for instance, the C-section shown in FIGS. 1*a* and 2 or the U-section shown in FIG. 3.

The top roller 12 and the bottom roller 14 each have a plurality of toothed disks 16, 17 arranged next to each other, which are shown in greater detail in FIGS. 6*a*, 6*b*, 7*a*, 7*b* and 8*a*-8*c*. The outside of each of the toothed disks 16, 17 has a row of teeth uniformly distributed along the circumference. Each tooth has a flat, essentially square tooth tip 18, whereby the sides of the square in the embodiment shown measure 0.4 mm in length. Moreover, each tooth has four flat flanks 19, whereby the angle between two opposing flanks is about 60° in the embodiments shown (see FIGS. 8*a* and 8*c*). Accordingly, the angle between the flanks 19 and the center plane M of the toothed disks 16, 17 is 30°.

The toothed disks 16, 17 each have a cavity 20 in their center that serves to accommodate a drive shaft (not shown here). Feather key grooves 21 are formed in the toothed disks 16, 17 in order to generate a positive fit between them and the drive shaft.

Figure 6A:
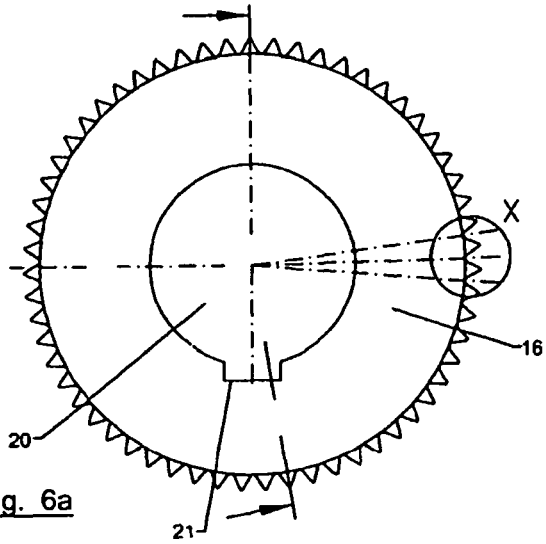
FIG. 6*a*: a schematic top view of a toothed disk of the top roller or bottom roller.
Figure 6B:
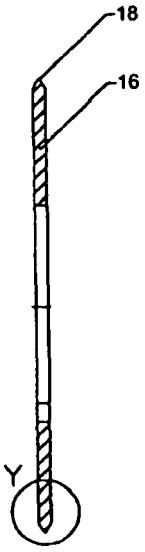
FIG. 6*b*: the toothed disk of FIG. 6*a* in a sectional view.
Figure 7A:
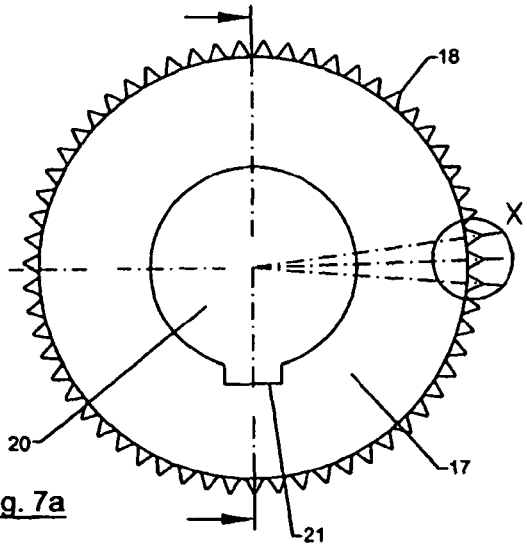
FIG. 7*a*: a schematic top view of another toothed disk of the top roller or bottom roller.
Figure 7B:
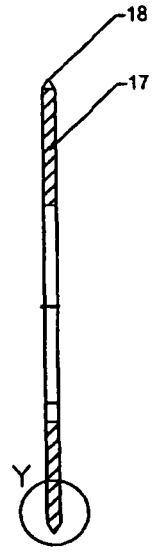
FIG. 7*b*: the toothed disk of FIG. 7*a* in a sectional view.
Figure 8A:
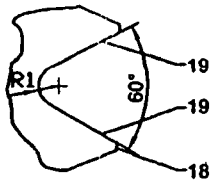
FIGS. 8*a*-8*c*: enlarged details of the individual teeth of the toothed disks of FIGS. 6*a* and 7*a;*
Figure 8B:
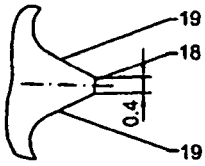
Figure 8C:
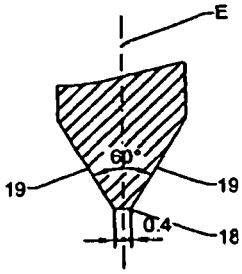

The toothed disks 16, 17 shown in FIGS. 6*a* and 7*a* are configured to be largely identical to each other. However, a difference does exist in that the teeth provided along the circumference are offset with respect to each other by half a tooth pitch relative to the feather key groove 21 formed in the cavity 20.

Figure 9A:
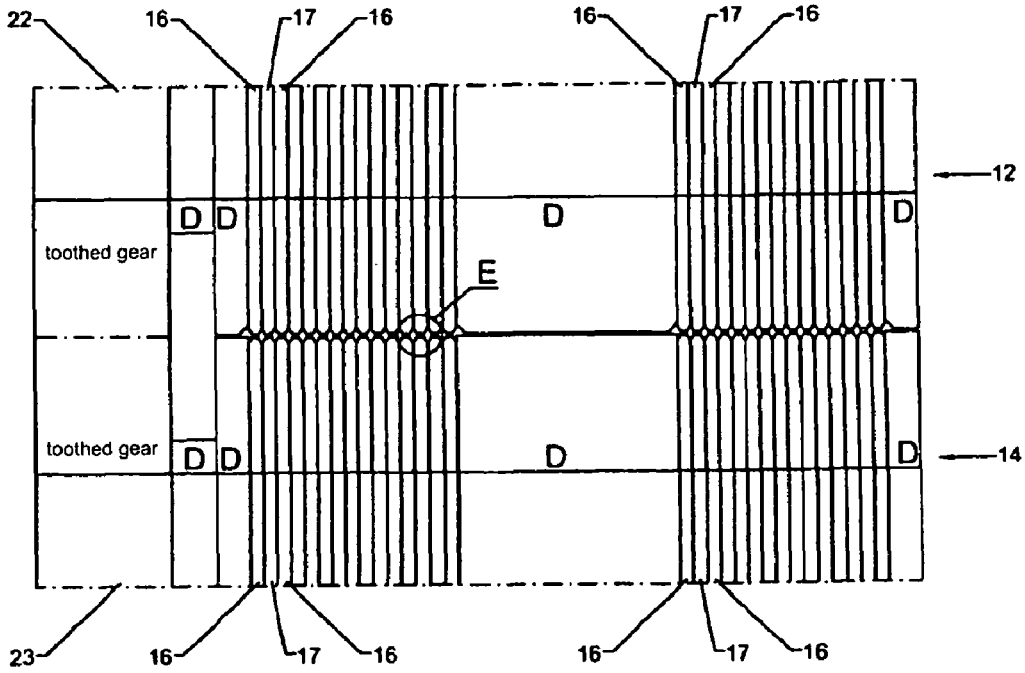
FIG. 9*a*: a schematic simplified view of the arrangement of the individual toothed disks of the top roller and bottom roller.

FIG. 9*a* illustrates in schematic form how the individual toothed disks 16, 17 are combined to form the appertaining top roller 12 and bottom roller 14.

The top roller 12 and the bottom roller 14 are only shown schematically and in a section in FIG. 9*a*. Thus, the line 22 indicates the position of the axis of rotation of the top roller 12, while the line 23 indicates the position of the axis of rotation of the bottom roller 14. Only the lower half of the top roller 12 and the upper half of the bottom roller 14 have been sketched. And yet, the drawing clearly shows that the toothed disks 16, 17 are arranged alternatingly on the top roller 12 as well as on the bottom roller 14. This means that a toothed disk 16 is located next to a toothed disk 17 and vice versa. The result of this is that the rows of teeth of the individual disks 16, 17 are each offset with respect to each other by half a tooth pitch and consequently, the teeth of the top and bottom rollers 12, 14 are arranged in diagonal rows.

The top roller 12 and bottom roller 14 also have several spacers D. They allow the sheet metal material to be fed between the top roller 12 and the bottom roller 14 without the sheet metal material becoming deformed in the areas formed by the spacers.

The top roller 12 and bottom roller 14 are each synchronously driven by toothed gears, as shown in FIG. 9*a*.

Figure 9B:
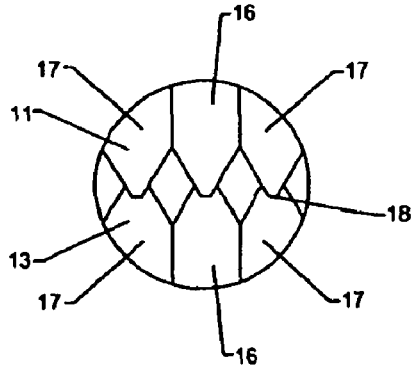
FIG. 9*b*: an enlarged detail of FIG. 9*a*.

As can be seen in FIG. 9*b*, the toothed disks 16, 17 of the top roller 12 are arranged without an axial offset relative to the toothed disks 16, 17 of the bottom roller 14. Accordingly, the tooth tips of the toothed disks 16, 17 of the top roller 12 each protrude into the center of the tooth gaps between two teeth of the toothed disks 16, 17 of the bottom roller 14.

LIST OF REFERENCE NUMERALS

1, 1', 1" fastening element
2 bottom section
3 leg section
4 strip
5 joining section
6 depression
7 elevation
8 bead
9 sliding surface
10 screw
11 first teeth
12 top roller
13 second teeth
14 bottom roller
15 sheet metal material
16 toothed disk
17 toothed disk
18 tooth tip
19 flank
20 cavity
21 feather key groove
22 axis of rotation
23 axis of rotation
M center line
N inclination angle
A center point distance
S material thickness
H height
D spacer
T depth
F enveloping surface

The invention claimed is:

1. A method for the production of a fastening element for dry construction elements comprising:

a sheet metal material having at least one joining section, the sheet metal material being provided with a plurality of depressions in the area of the at least one joining section, the depressions being formed by deformed areas of the sheet metal material, so that the depressions on one side of the sheet metal material form elevations on an opposite side of the sheet metal material, the depressions each being surrounded by sliding surfaces at least partially slanted relative to an imaginary center line of the sheet metal material and being for connectors to be inserted into or through the joining section, wherein, in the at least one joining section, the sheet metal material has no surface parallel to the imaginary center line of the sheet metal material, except for the depressions or elevations, the method comprising:

feeding a flat sheet metal material through a nip formed between a top roller having first teeth and a bottom roller having second teeth, in order to create the depressions and elevations as well as the slanted sliding surfaces.

2. The method according to claim 1 wherein the top roller and/or the bottom roller has a plurality of toothed disks arranged next to each other.

3. The method according to claim 1 wherein the toothed disks have a row of first or second teeth on their circumference.

4. The method according to claim 1 wherein the teeth each have four straight flanks slanted by 25° to 35° relative to the center plane of the toothed disk.

5. The method according to claim 1 wherein the teeth each have four straight flanks slanted by 30° relative to the center plane of the toothed disk.

6. The method according to claim 1 wherein the first teeth of the top roller and the second teeth of the bottom roller intermesh.

7. The method according to claim 1 wherein the top roller and the bottom roller are arranged in such a way that one of the first teeth protrudes into the middle of a gap between two of the second teeth.

* * * * *